US008396409B2

(12) United States Patent
Azami et al.

(10) Patent No.: US 8,396,409 B2
(45) Date of Patent: Mar. 12, 2013

(54) PRINTING APPARATUS

(75) Inventors: Osamu Azami, Shiojiri (JP); Ryoji Tamaoki, Kani (JP); Yasushi Otaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 519 days.

(21) Appl. No.: 12/684,805

(22) Filed: Jan. 8, 2010

(65) Prior Publication Data

US 2010/0178067 A1 Jul. 15, 2010

(30) Foreign Application Priority Data

Jan. 9, 2009 (JP) ..... 2009-003404
Aug. 21, 2009 (JP) ..... 2009-192093

(51) Int. Cl.
*G03G 15/00* (2006.01)

(52) U.S. Cl. ..... 399/389; 399/38

(58) Field of Classification Search ..... 399/389
See application file for complete search history.

(56) References Cited

U.S. PATENT DOCUMENTS 5,061,958 A * 10/1991 Bunker et al. ..... 399/81
5,172,178 A * 12/1992 Oushiden et al. ..... 399/86
5,229,814 A * 7/1993 Hube et al. ..... 399/14
5,267,727 A * 12/1993 DeHority ..... 270/1.02
5,355,205 A * 10/1994 Toyama et al. ..... 399/14
5,448,685 A * 9/1995 Ogura et al. ..... 358/1.18
6,606,466 B2 * 8/2003 Sato ..... 399/82
6,775,488 B2 8/2004 Sawada
6,963,721 B2 * 11/2005 Asai et al. ..... 399/391
6,978,114 B2 * 12/2005 Okamoto et al. ..... 399/389
8,179,559 B2 * 5/2012 Sawada ..... 358/1.2

FOREIGN PATENT DOCUMENTS

JP 08-339100 A 12/1996
JP 2002-036679 A 2/2002
JP 2002-248831 A 9/2002
JP 2003-341191 A 12/2003

* cited by examiner

*Primary Examiner* — Anthony Nguyen
(74) *Attorney, Agent, or Firm* — Kilpatrick Townsend & Stockton LLP

(57) ABSTRACT

A printing apparatus including one or more feeding units includes: a sheet size determining unit which determines a sheet size of a sheet, on which print data are printed, in predetermined order; a print control unit which stores a designated size, which is the sheet size determined by the sheet size determining unit, in a storage unit; a feeding unit selector which selects the feeding unit on the basis of the designated size; and a process selection information storing unit which stores process selection information used to designate a process executed by the print control unit.

8 Claims, 14 Drawing Sheets

PRINTING APPARATUS

BACKGROUND

1. Technical Field

The present invention relates to a printing apparatus, and more particularly, to a printing apparatus including one or more feeding units.

2. Related Art

There are Letter sheet cultures (at present, the United States, Canada, and some areas of the United Mexican State) where the letter size is used as a normal sheet and A4 sheet cultures (other nations) where the A4 size is used as a normal sheet. The size of the A4 sheet and the size of the Letter sheet are similar to each other, but are subtly different from each. Therefore, in order to print data in which a sheet of the Letter size is designated to be printed in the A4 sheet cultures, it is necessary to prepare the sheet of the Letter size and change the sheet by an application or it is necessary to reduce the data size to the size of the A4 sheet upon the printing. Of course, the same problem also arises when data sent from the A4 sheet cultures are printed in the Letter sheet cultures.

In general, in order to solve this problem, the printing is executed on different sheets. For example, in a printer equipped with a plurality of feeding trays, a priority order is determined for the different feeding trays and the sheets are replaced in accordance with the priority order. With this method, downtime can be reduced since a sheet error does not occur. However, data may be printed on the sheet of a size that is completely different from a designated size. When the sheet size is smaller than the size of the data, the edges of the data may not be printed. Moreover, when important information is present in the portions which are not printed, a sheet or ink has to be additionally used in re-printing and it takes more time.

Accordingly, as disclosed in JP-A-2002-36679 and JP-A-2002-248831, a sheet size replaceable for each output sheet is determined in advance and printing is executed on the replacement sheet upon non-existence of a sheet so as not to execute the re-printing.

JP-A-2002-248831 discloses a technique in which printing is executed on the replacement sheet by setting the replaceable sheet for each output sheet and setting the existence or non-existence of change magnification used to execute the printing on the replacement sheet or the print position on a print sheet.

However, some users want a variety of print qualities and some users want printing without change in the setting of print data. Some users want a print result to be immediately printed even though the end of the print result is not printed to some extent. Some users do not care about the print result set in the print data as long as the print quality is ensured to some extent. Moreover, the technique disclosed in JP-A-2002-36679 or JP-A-2002-248831 has a problem in that the replacement sheet has to be set every sheet and thus it takes some time to execute settings.

SUMMARY

An advantage of some aspects of the invention is that it provides a printing apparatus capable of selecting optimum setting depending on a use environment of the printing apparatus to reduce downtime.

According to an aspect of the invention, there is provided a printing apparatus including one or more feeding units. The printing apparatus includes a sheet size determining unit, a print control unit, a feeding unit selector, and a process selection information storing unit.

The sheet size determining unit determines a sheet size of a sheet, on which print data are printed, in predetermined order. As for the predetermined order, when a plurality of sheet sizes is set in the print data, the sheet size having the highest priority is determined. When the sheet size is not set in the print data, a default sheet size is determined. The priority is set in advance in accordance with the importance of each setting method. When the sheet size is determined, the print control unit stores the sheet size as a designated size in the storage unit.

The feeding unit selector selects the feeding unit on the basis of the designated size stored in the storage unit. The feeding unit selector selects this feeding unit, when the sheet is accommodated in the feeding unit accommodating the sheet of the designated size. However, the feeding unit selector selects another feeding unit in the predetermined order, when no sheet exists in the feeding unit accommodating the sheet of the designated size.

The print control unit selectively executes the process on the basis of the process selection information stored in the process selection information storing unit, while using the sheet size of the sheet accommodated in the feeding unit selected by the feeding unit selector and the designated size. The process selection information is information used to designate one of the first to third processes.

First, when the sheet size set in the feeding unit selected by the feeding unit selector is identical to the designated size, the print control unit executes the printing on the sheet in the feeding unit selected by the feeding unit selector in the first to third processes. This is because the printing is executed on the sheet of the designated size upon the printing on the sheet fed from the selected feeding unit.

Next, when the sheet size set in the feeding unit selected by the feeding unit selector is different from the designated size and the first process is designated by the process selection information, the print control unit gives notice that no sheet exists. When the sheet of the designated size is supplemented, the printing is executed on the supplemented sheet.

That is, in the first process, the printing is on standby until the sheet of the designated size is supplemented. Accordingly, the printing can reliably be executed with the size intended upon the generation of the print data. Of course, when the print result is not important, the printing may be permitted with the sheet size set in the feeding unit selected by the feeding unit selector after the wait for the supplement of the sheet. In this way, some print result can be immediately obtained.

When the sheet size set in the feeding unit selected by the feeding unit selector is different from the designated size and the second process is designated by the process selection information, the print control unit selects the feeding unit on the basis of the replacement size of the designated size. When the sheet size set in the selected feeding unit is identical to the replacement size, the printing is executed on the sheet of the selected feeding unit.

In the second process, when no sheet of the designated size exists, the feeding unit is selected on the basis of the replacement size of the designated size. When the sheet is accommodated in the feeding unit accommodating the sheet of the replacement sheet, the print control unit selects this feeding unit. However, the feeding unit selector selects another feeding unit in the predetermined order, when no sheet exists in the feeding unit accommodating the sheet of the designated size. A variety of replacement sizes can be set for a predetermined sheet size. However, it is desirable that the replacement size is a size which can be printed without printing print data beyond the sheet, even when the print data of a predetermined sheet size is printed on the sheet of the replacement size similar to the sheet size. The second process is suitable for a user that wants a print result to be immediately printed even though the end of the print result is cut off to some extent.

When the sheet size set in the feeding unit selected by the feeding unit selector is different from the designated size and the third process is designated in the process selection information, the print control unit gives notice that no sheet exists. When the sheet of the designated size is supplemented before the expiration of a predetermined period of time from the notice, the printing is executed on the sheet. When the notice that no sheet exists is given and then the sheet of the designated size is not supplemented before the expiration of the predetermined period of time, the printing is executed on the sheet of the replacement size of the designated size.

In the third process, when the sheet of the designated size is supplemented in the feeding unit within the predetermined period of time, the printing can be executed on the sheet of the designated size. Alternatively, when the sheet of the designated size is not supplemented in the feeding unit within the predetermined period of time, the printing can be executed automatically on the sheet of the replacement size of the designated size. Accordingly, the third process is suitable for a user that wants a print result to be immediately printed even though the end of the print result is cut off to some extent. Moreover, the third process is suitable for a user that does not care about the print result set in the print data as long as the print quality is ensured to some extent.

In this way, one of the first to third processes can be selectively executed when no sheet of the designated size exists. Accordingly, since the optimum setting can be selected depending on the use environment of the printing apparatus, it is possible to reduce the downtime.

According to another aspect of the invention, there is provided a printing apparatus including one or more feeding units. The printing apparatus includes a sheet size determining unit, a print control unit, a feeding unit selector, and a process selection information storing unit.

The sheet size determining unit determines a sheet size of a sheet, on which print data are printed, in predetermined order. As for the predetermined order, when a plurality of sheet sizes is set in the print data, the sheet size having the highest priority is determined. When the sheet size is not set in the print data, a default sheet size is determined. The priority order is set in advance in accordance with the importance of each setting method. When the sheet size is determined, the print control unit stores the sheet size as a designated size in the storage unit.

The feeding unit selector selects the feeding unit on the basis of the designated size stored in the storage unit. The feeding unit selector selects this feeding unit, when the sheet is accommodated in the feeding unit accommodating the sheet of the designated size. However, the feeding unit selector selects another feeding unit in the predetermined order, when no sheet exists in the feeding unit accommodating the sheet of the designated size.

The print control unit selectively executes one of first, second, and fourth processes on the basis of the process selection information stored in the process selection information storing unit, while using the sheet size of the sheet accommodated in the feeding unit selected by the feeding unit selector and the designated size. The process selection information is information used to designate one of the first, second, and fourth processes.

First, when the sheet size set in the feeding unit selected by the feeding unit selector is identical to the designated size, the print control unit executes the printing on the sheet in the feeding unit selected by the feeding unit selector in the first and second processes. This is because the printing is executed on the sheet of the designated size upon the printing on the sheet fed from the selected feeding unit.

Next, when the sheet size set in the feeding unit selected by the feeding unit selector is different from the designated size and the first process is designated by the process selection information, the print control unit gives notice that no sheet exists. When the sheet of the designated size is supplemented, the printing is executed on the supplemented sheet.

That is, in the first process, the printing is on standby until the sheet of the designated size is supplemented. Accordingly, the printing can reliably be executed with the size intended upon the generation of the print data. Of course, when the print result is not important, the printing may be permitted with the sheet size set in the feeding unit selected by the feeding unit selector after the wait for the supplement of the sheet. In this way, some print result can be immediately obtained.

When the sheet size set in the feeding unit selected by the feeding unit selector is different from the designated size and the second process is designated by the process selection information, the print control unit selects the feeding unit on the basis of the replacement size of the designated size. When the sheet size set in the selected feeding unit is identical to the replacement size, the printing is executed on the sheet of the selected feeding unit.

In the second process, when no sheet of the designated size exists, the feeding unit is selected on the basis of the replacement size of the designated size. When the sheet is accommodated in the feeding unit accommodating the sheet of the replacement sheet, the print control unit selects this feeding unit. However, the feeding unit selector selects another feeding unit in the predetermined order, when no sheet exists in the feeding unit accommodating the sheet of the designated size. A variety of replacement sizes can be set for a predetermined sheet size. However, it is desirable that the replacement size is a size which can be printed without printing print data beyond the sheet, even when the print data of a predetermined sheet size is printed on the sheet of the replacement size similar to the sheet size. The second process is suitable for a user that wants a print result to be immediately printed even though the end of the print result is cut off to some extent.

When the fourth process is designated by the process selection information, the print control unit generates actual data (raster data or immediate data generated on the basis of image data, document data, or the like) on the basis of the print data so that the dimension of the actual data is identical to the replacement size of the designated size. Moreover, the print control unit executes the printing on the sheet of the replacement size of the designated size on the basis of the actual data of which the dimension is changed.

That is, in the fourth process, the dimension of the actual data generated on the basis of the print data is changed into the replacement size. For example, in the fourth process, a replacement size for the sheet of a specific size is set. Then, when the designated size determined by the sheet size determining unit is the specific size and the fourth process is designated by the process selection information, a print result suitable for the replacement size can be obtained without the awareness of the user. In recent years, direct printing executed by directly sending a file to a printer or reading a file from a connected storage medium without using an application or a driver is used. In the direct printing, since the application or the driver is not used, it is not easy to magnify or reduce data.

The fourth process is suitable for the direct printing, since the print result suitable for the replacement size can be obtained automatically.

When no sheet of the designated size exists, one of the first, second, fourth processes can be selectively executed. Accordingly, since an optimum setting can be selected depending on the use environment of the printing apparatus, it is possible to reduce the downtime.

In the printing apparatus according to the above aspect of the invention, in the second process, the print control unit may execute the printing at a reduction ratio at which the sheet size determined by the sheet size determining unit falls within the range of the replacement size. With such a configuration, even when the print data in which the sheet of the designated size is set in the printing is printed on the sheet of the replacement size, the entire print data are printed without the cut-off of the end of the print result.

In the printing apparatus according to the above aspect of the invention, the print control unit may set the entire sheet containing a clip area to a print range, whenever executing the printing on the sheet of the replacement size. The printing on the replacement sheet is executed as an unusual measure. It is important to obtain the complete print result similar to the original rather than ensuring the clip area where a header/footer or the like are ensured in the unusual case. By ignoring the clip area, the print result formed by effectively using the entire sheet can be obtained.

In the printing apparatus according to the above aspect of the invention, in the second process, the print control unit may give notice that no sheet of both the sheet size determined by the sheet size determining unit and the replacement size exists, when no sheet of the replacement size exists. That is, the fact of trying the printing with both the designated size and the replacement size of the designated size is reliably conveyed to the user.

In the printing apparatus according to the above aspect of the invention, in the first process, when the printing is executed on the sheet of the replacement size, the print control unit may give notice of the printing. In the second process, even when the printing is executed on the sheet of the replacement size, the print control unit may not give notice of the printing. In the first process, it is not clear to the user which sheet is replaced, and the print data may be printed on a completely different sheet in some cases. Accordingly, it is good that this fact is notified to the user. On the other hand, in the second process, the sheet is replaced in the range assumed for the user. Accordingly, the notice that the sheet is replaced is omitted in order to inhibit an increase in the downtime occurring due to the notice.

In the printing apparatus according to the above aspect of the invention, when the printing apparatus is turned on and then the third process is executed twice or more, the print control unit may give notice that no sheet exists and select the feeding unit on the basis of the replacement size of the designated size without awaiting the expiration of the predetermined period of time. When the sheet size set in the selected feeding unit is identical to the replacement size, the print control unit may execute the printing on the sheet in the selected feeding unit. With such a configuration, only when the printing apparatus is turned on and then no sheet exists, the predetermined period of time has to expire. Moreover, since the situation where the predetermined period of time has to expire does not occur frequently, it is possible to reduce the downtime.

In the printing apparatus according to the above aspect of the invention, when one of the A4 sheet and the Letter sheet is designated as the designated size, the print control unit sets the other of the A4 sheet and the Letter sheet as the replacement size. With such a configuration, when documents prepared in one of the Letter sheet cultures and the A4 sheet cultures are prepared in the other, the printing can be executed smoothly. By smoothly replacing the sheets in each culture, it is possible to effectively reduce the downtime.

The above-described printing apparatus can be mounted in another apparatus or realized in another method. The aspect of the invention can be realized in a printing system including the above-described printing apparatus, a print controlling method including steps corresponding to the configuration of the above-described printing apparatus, a program causing functions corresponding to the configuration of the above-described printing apparatus to be executed, a computer readable record medium recording the program, or the like. The printing system, the print controlling method, the print control program, and the medium recording the program can obtain the above-described operations and advantages. Of course, the configurations according to the aspect of the invention are applicable to the printing system, the print controlling method, the program, and the print medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in the following order.

Figure 1:
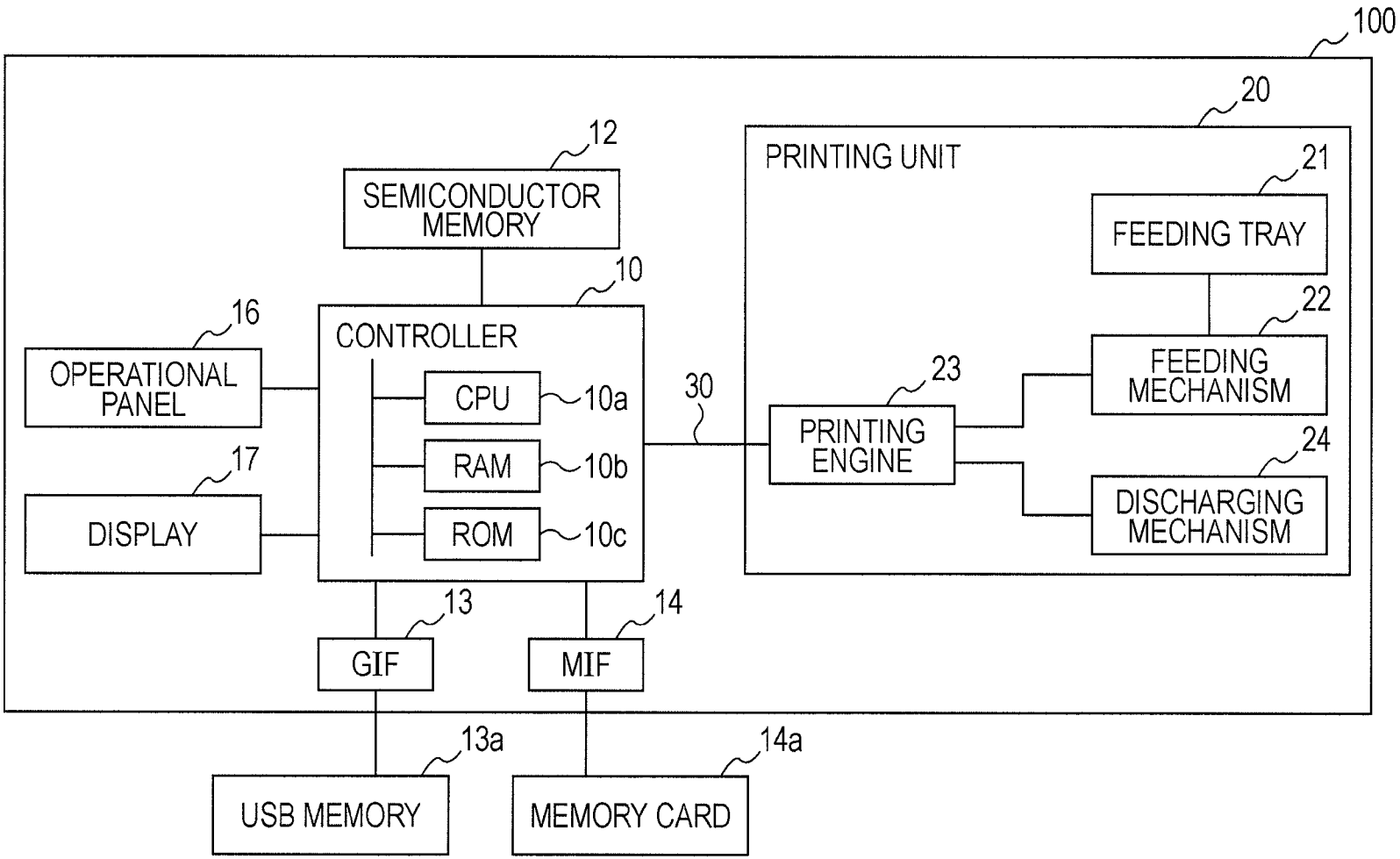
FIG. 1 is a block diagram illustrating the hardware configuration of a printer.

(1) Configuration of Printing Apparatus
(2) Print Setting
(3) Print Control Process
(4) Feeding Port Selection Process
(4-1) Normal Selection Process
(4-2) Replacement Process
(4-3) Automatic Continuity Process
(5) Summary (1) Configuration of Printing Apparatus FIG. 1 is a block diagram illustrating the hardware configuration of a printer, which is a realized example of a printing apparatus according to an embodiment of the invention. In FIG. 1, a printer 100 generally includes a controller 10 and a printing unit 20. The controller 10 and the printing unit 20 are connected to each other through a bus 30 in a communicable way. The communication executed through the bus 30 is controlled by a chip set or the like (not shown).

The controller 10 includes a CPU 10*a*, a RAM 10*b*, and a ROM 10*c*. The printer 100 can be controlled by loading program data stored in the ROM 10*c* into the RAM 10*b* under the control of the CPU 10*a* and executing the arithmetic operation of the CPU 10*a* in accordance with the loaded program data. The program data stored in the ROM 10*c* refer to firmware that controls the hardware of the printer 100 while displaying a user interface (UI) on a display 17 and receiving an operation input of a user on an operational panel 16 or programs that are used to execute print control, which is described below.

The operational panel 16 is disposed as plural buttons, for example, on the case of the printer 100 and the CPU 10*a* acquires signals indicating input operations of the operational panel 16.

The display 17 is capable of displaying various types of information, images, or the like on the basis of the input data. The CPU 10*a* inputs data indicating the contents that are displayed on the display 17. As a consequence, the various kinds of information, the images, or the like are displayed on the display 17.

A semiconductor memory 12, a general interface (GIF) 13, a memory card interface (MIF) 14 are also connected to the controller 10. The semiconductor memory is a non-volatile memory such as the EEPROM (registered trademark) (Electrically Erasable and Programmable Read Only Memory). Setting values used for controlling the printer 100 are stored in the semiconductor memory. The GIF 13 is an interface to which an external computer is connected or an external apparatus such as an apparatus capable of reading and writing data from and to an external semiconductor memory is connected. For example, the GIF 13 is an interface connected to an interface conforming to the USB (Universal Serial Bus) standard or connected to the LAN (Local Area Network). The MIF 14 is connected to a slot into which a memory card 14*a* is inserted. Therefore, the CPU 10*a* is able to gain access to the memory card 14*a* through the MIF 14 to read and write files.

The printing unit 20 includes a plurality of feeding trays 21 that each receive sheets of various sizes, a feeding mechanism 22 that supplies the sheet received in one feeding tray designated by the controller 10 into the printer, a printing engine 23 that controls printing on the sheet on the basis of raster data designated by the controller 10, and a discharging mechanism 24 that discharges the sheet outside the printer. The printing unit 20 includes a transporting mechanism, a carriage mechanism, and a printing head, which are controlled by the printing engine 23.

The printing engine 23 according to this embodiment is constituted by a tandem engine or a four-stroke engine, for example. The tandem engine forms a color image by forming each one pixel of CMYK color images repeatedly and sequentially and executing overlap printing on the image data of plural planes. The four-stroke engine forms an image by forming each one page of the CMYK color images repeatedly and sequentially and sequentially processing the image data of plural planes.

The controller 10 generates image data of each plane of CMYK (hereinafter, the image data of each plane of CMYK is referred to as "raster data") on the basis of the input print data or forming an intermediate code indicating a print target designated by the print data, and stores the generated image data or the formed intermediate code in an area (hereinafter, referred to as an image memory) of the RAM 10*b* where the image data is stored. In this embodiment, the raster data or the intermediate code correspond to actual data. In the following description, a case of generating the raster data on the basis of the print data will be described.

The controller 10 executes printing on the basis of the print data by sequentially outputting the raster data of each plane stored in the image memory to the printing engine 23 in accordance with process characteristics of the printing engine 23 in response to a vertical synchronous signal of each plane sent from the printing engine 23.

In this embodiment, the printer 100 is assumed to have only a printing function. However, a so-called multi-function apparatus having various functions such as a copy function or a scanning function may, of course, be used.

Figure 2:
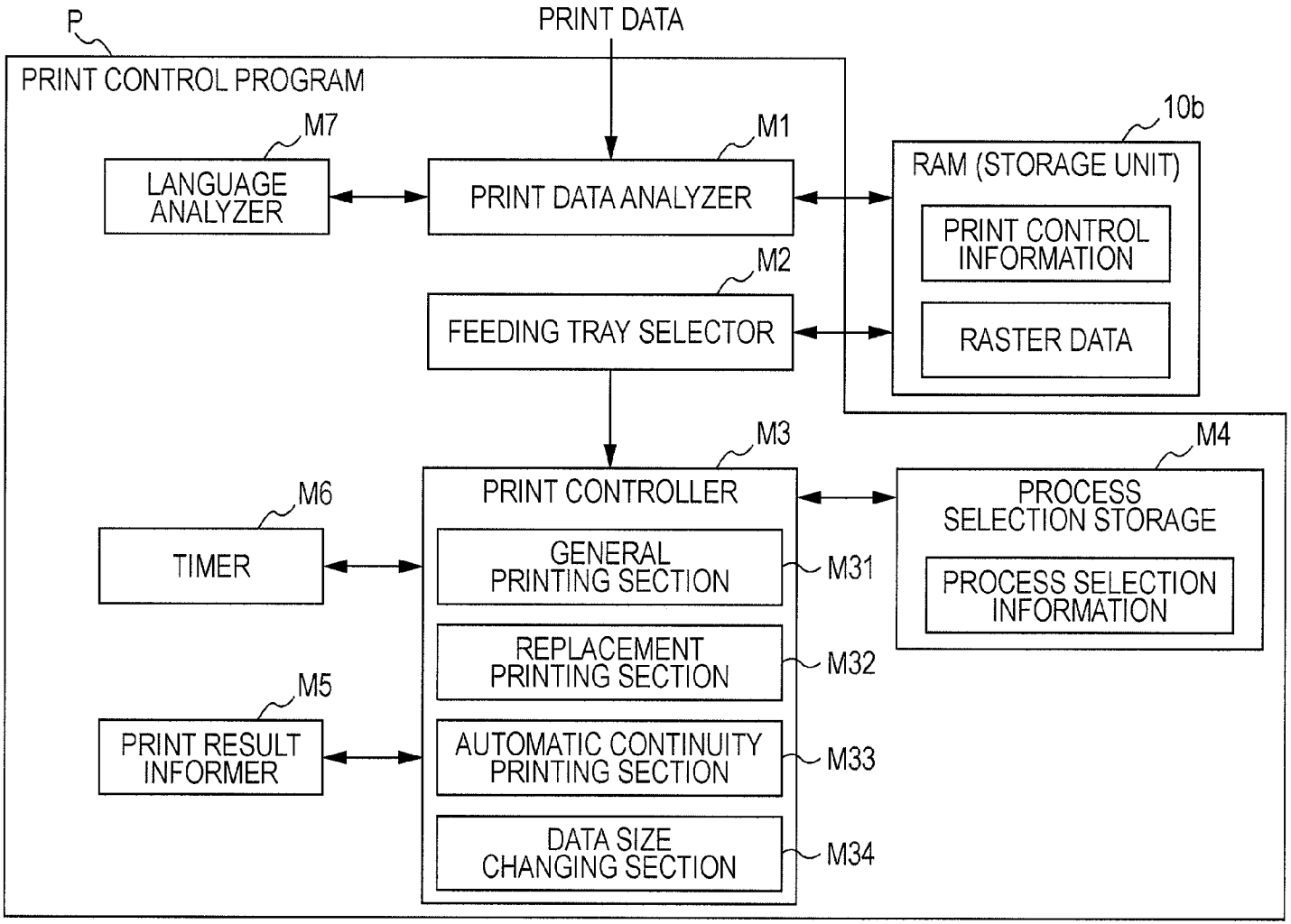
FIG. 2 is a block diagram illustrating the software configuration of the printer.

FIG. 2 is a block diagram illustrating the software configuration of the printer 100. In FIG. 2, a print control program P executed in the printer 100 executes a print control process of printing a print work or image data (hereinafter, referred to as print data) on a sheet, when the print work described in a predetermined page description language or a predetermined print work control language is input from a driver of an external computer or the image data, PDF (Portable Document Format) data, or the like is acquired as a print target from the memory card 14*a* or the USB memory 13*a* through firmware.

The print control program P includes a print data analyzer M1, a feeding tray selector M2, a print controller M3, a process selection storage M4, a print result informer M5, a timer M6, and a language analyzer M7. The print controller M3 includes a general printing section M31, a replacement printing section M32, an automatic continuity printing section M33, and a data size changing section M34.

In this configuration, the print data analyzer M1 generates the raster data on the basis of the print data input into the printer 100 or generates print control information used to designate the size of a sheet, a feeding port, or the like used in the printing by the printing engine 23. In the following description, a sheet size set in the print control information is referred to as "a designated size" and a sheet of the designated size is referred to as "a designated sheet".

For example, the print data analyzer M1 generates bitmap image data formed by expressing pixels with gray scale values of RGB, while allowing the language analyzer M7 to analyze the print data on the basis of the input print data, if necessary. Moreover, the print data analyzer M1 generates the raster data and stores the generated raster data in the RAM 10*b* by executing a color conversion process (for example, a process of converting colors from a RGB color space to a CMYK color space), a halftone process, and a rasterization process, while executing a resolution conversion process, if necessary.

The print data analyzer M1 acquires the designated size by acquiring the sheet size described in a printer job language (PJL) or the sheet size described in a page description language (PDL) under the control of the language analyzer M7 or by acquiring the sheet size set as a default. The print data analyzer M1 acquires information regarding the feeding port designated for the print data under the language analyzer M7.

This acquired print control information is temporarily stored as an environment variable in a storage medium such as the RAM 10*b*. The feeding tray selector M2 selects the feeding tray on the basis of the environment variable stored in the RAM 10*b*.

The size of a print sheet is repeatedly set, since the size of the print sheet can be designated in any one of the PDL, the PJL, and the default settings.

The PDL is a language such as the PostScript used in a page printer and a control code system or a script language used to describe a print image by using a page as unit.

The PJL is a language used to change the setting value of the default into a remote and a language being present outside the print data and selecting the layout or the like of the print data.

The setting value of the default, which is a setting value used in an application for printing data having no information regarding the size per page, such as DOS, and designates the default sheet size used when the page size of the print data is not designated.

When the size of the print sheet is repeatedly designated in plural methods, the print data analyzer M1 stores the size of a higher priority as the designated size in the environment variable. When the priority order of the designation method is determined in this embodiment, the EJL setting has priority over the default setting and the PDL setting has priority over the EJL setting. That is, the setting designated by the user is preferred.

Figure 3:
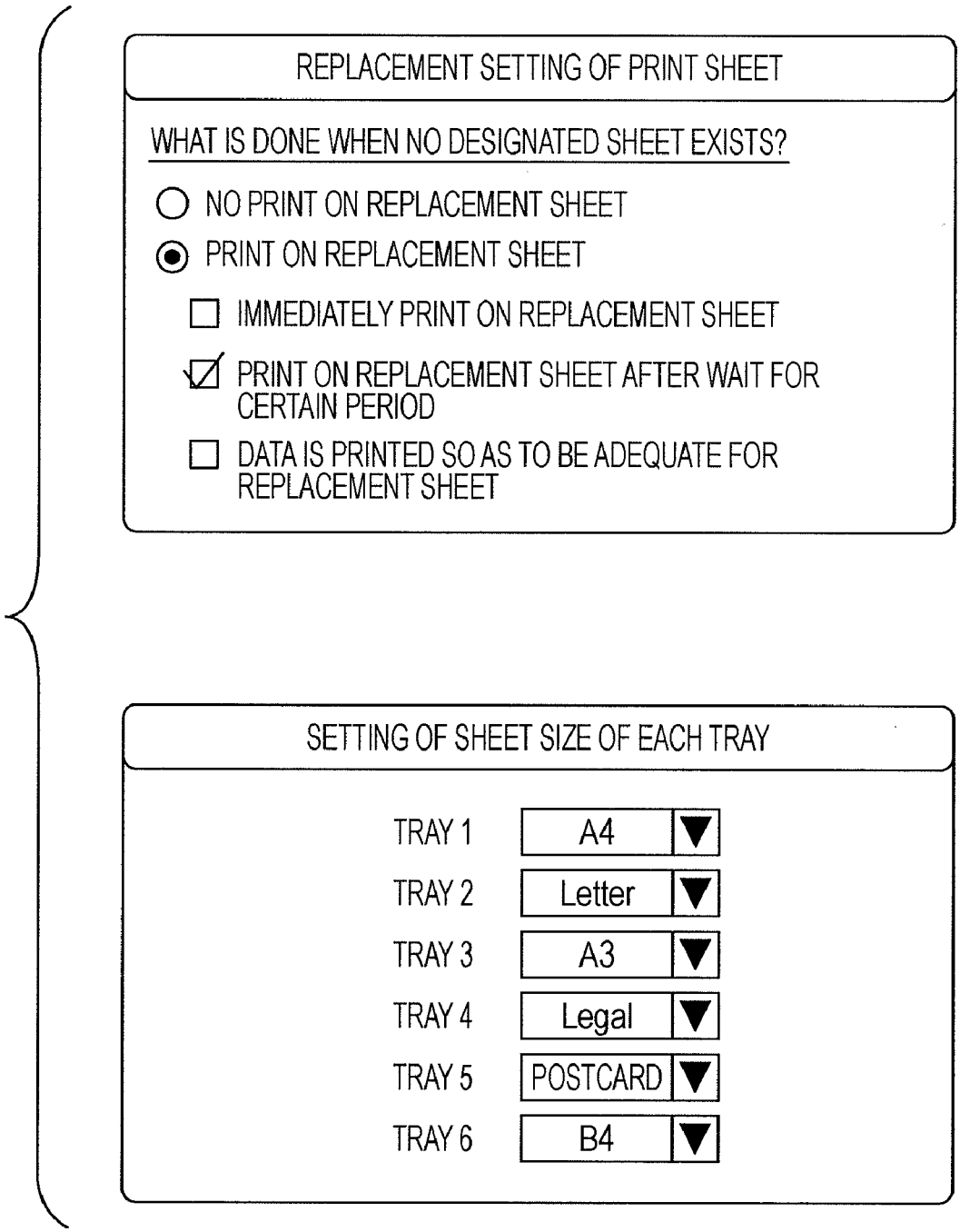
FIG. 3 is a diagram illustrating an example of a user interface used to set print parameters.

The print controller M3 determines which is set among replacement OFF, replacement ON, automatic continuity, or FitPage, which are described. More specifically, the print controller M3 determines the present replacement setting on the basis of the setting value acquired from the semiconductor memory 12. The setting values of the replacement settings of the print sheet set by a UI shown in FIG. 3 are stored in the semiconductor memory 12.

When the replacement OFF is set as the replacement setting, the print controller M3 causes the print data analyzer M1 to analyze the print data and generate the actual data or the environment variable, and then causes the general printing section M31 to execute the printing. When the replacement ON is set as the replacement setting, the print controller M3 causes the print data analyzer M1 to analyze the print data and generate the actual data or the environment variable, and then causes the replacement printing section M32 to execute the printing. When the automatic continuity is set as the replacement setting, the print controller M3 causes the print data analyzer M1 to analyze the print data and generate the actual data or the environment variable, and then causes the automatic continuity printing section M33 to execute the printing. When the FitPage is set as the replacement setting, the print controller M3 causes the data size changing section M34 to analyze the print data and generate the actual data or the environment variable, and then causes the general printing section M31 to execute the printing.

In this embodiment, a print control process executed in the general printing section M31 under the control of the print controller M3 corresponds to a first process. A print control process executed in the replacement printing section M32 under the control of the print controller M3 corresponds to a second process. A print control process executed in the automatic continuity printing section M33 under the control of the print controller M3 corresponds to a third process. A print control process executed in the general printing section M31 and the data size changing section M34 under the control of the print controller M3 corresponds to a fourth process. In this embodiment, the setting values of the replacement settings stored in the semiconductor memory 12 constitute process selection information.

The general printing section M31 determines which feeding tray 21 of the printer 100 loads the designated sheet. When the designated sheet is loaded, the general printing section M31 instructs the printing unit 20 to execute the printing on the designated sheet in accordance with the environment variable. Alternatively, when the designated sheet is not loaded, the general printing section M31 instructs the printing unit 20 to execute the printing on the sheet of the size selected in a predetermined use order.

An arrangement order of the feeding trays, an order of a larger sheet-size, a frequently-used order, or the like having nothing to do with the designated sheet size is set as the predetermined use order. The general printing section M31 temporarily stores information regarding the size of the sheet used in effect in the printing in the RAM 10*b*. In the following description, the size of the sheet used in effect in the printing is referred to as "a normal sheet size". The information regarding the normal sheet size stored in this manner is used by the print result informer M5.

The replacement printing section M32 determines which feeding tray 21 of the printer 100 loads the designated sheet. When the designated sheet is loaded, the replacement printing section M32 instructs the printing unit 20 to execute the printing on the designated sheet in accordance with the environment variable. When the designated sheet is not loaded, the replacement printing section M32 instructs the printing unit 20 to execute the printing on the replacement sheet. Alternatively, when the designated sheet does not loaded in any one of the feeding trays 21, the replacement printing section M32 instructs the printing unit 20 to execute the printing on the sheet of the size selected in the predetermined use order, like the general printing section M31. The replacement sheet refers to a sheet having a replacement relationship and a similar size. For example, the A4 sheet can be replaced by the Letter sheet and the A3 sheet can be replaced by the Legal sheet. Hereinafter, a sheet size which can replace "the designated size" is referred to as "the replacement size.

The replacement printing section M32 stores and maintains the replacement relationship (A4 sheet to/from Letter sheet, A3 sheet to/from Legal sheet, and the like) between the sheets. Therefore, the replacement printing section M32 designates a scale ratio, when instructing the printing unit 20 to execute the printing on the replacement sheet. The replacement printing section M32 stores and maintains size change ratios (for example, a change ratio used when A4 is replaced by the Letter sheet, a change ratio used when the Letter sheet is replaced by the A4 sheet, and the like) for the respective replacement directions used in the sheets having the replacement relationship. The replacement printing section M32 designates an extension ratio or a reduction ratio so that the size change ratio is suitable for the size of the replacement sheet, when executing the printing on the replacement sheet. When instructing the printing unit to execute the printing on the replacement sheet, the replacement printing section M32 stores the intention in the RAM 10*b*. When the printing cannot be executed on the replacement sheet, information regarding the size (normal sheet size) of the sheet used in effect in the printing is temporarily stored in the RAM 10*b* or the like. The stored information is used by the print result informer M5.

The automatic continuity printing section M33 determines how many feeding trays 21 of the printer 100 load the designated sheet. When the designated sheet is loaded, the automatic continuity printing section M33 instructs the printing unit 20 to execute the printing on the designated sheet in accordance with the environment variable. Alternatively, when the designated sheet is not loaded, the automatic continuity printing section M33 waits for a predetermined timeout period, while monitoring an opening or closing status of the feeding tray or the supplement status of sheets and an input operation of a continuity button of the operational panel. As for the timeout period, a sufficient period of time (for example, five minutes) is set so that a user can bring sheets stocked in a place where office supplies are kept and supplement the sheets in the feeding tray, because the designated sheet needs to be supplemented in the feeding tray.

When the timeout period expires, the automatic continuity printing section M33 instructs the printing unit 20 to execute the printing on the replacement sheet. When the replacement sheet is not loaded in any one of the feeding trays 21, the automatic continuity printing section M33 instructs the printing unit 20 to execute the printing on the sheet selected in the predetermined use order, like the general printing section M31. When receiving the input operation indicating supplement completion, the automatic continuity printing section M33 may not await the timeout period and instruct the printing unit 20 to execute the printing on the replacement sheet. When the feeding tray 21 is being opened, the automatic continuity printing section M33 may temporarily stop the counting of the timeout period. This is because there is a high possibility that the user is supplementing the sheets.

The data size changing section M34 causes the print data analyzer M1 to analyze the print data and generate the actual data or the environment variable. When the raster data is generated from the print data, the data size changing section M34 changes the vertical and horizontal sizes so as to be suitable for the size of the replacement sheet. The change in the size is not executed at the scale ratio in the print control information designated for the printing engine 23, but the size of the raster data (actual data) input into the printing engine 23 is directly changed. The data size changing section M34 changes the designated size set in the environment variable into the size of the replacement sheet. The change in the size of the raster data by the data size changing section M34 is explicitly executed by the user, and information regarding the change in the size of the raster data is not used later.

When the designated size and the normal sheet size are different from each other, the print result informer M5 notifies the user of this fact. However, when the designated size and the normal sheet size are different from each other but the replacement printing is executed, this fact is not notified to the user since the user has permitted the replacement printing. Specifically, the print result informer M5 acquires the designated size of the environment variable and the information regarding the normal sheet size stored in the RAM 10*b* or the like and acquires the setting values (settings of the replacement OFF, the replacement ON, the automatic continuity, or the FitPage) from the semiconductor memory 12. When the designated size and the normal sheet size are different from each other and the setting value is also not the replacement ON, the fact that the printing is executed on a sheet different from the designated size is displayed as error information on the display 17.

The timer M6 generates a clock signal and supplies the clock signal to each unit through the bus 30.

The language analyzer M7 has a function of analyzing a print job control language such as the EJL (Epson Job control Language) or a function of analyzing a page description language.

(2) Print Setting

FIG. 3 is a diagram illustrating an example of a user interface used to set print parameters. The user interface is used for the controller 10 to execute a display on the display 17 by inputting a predetermined operation on the operational panel 16. When the user operates the operational panel 16 in a state where the user interface is displayed, the controller 10 stores a variety of setting values in the semiconductor memory 12. The user can set parameters regarding the replacement printing through a print setting window. Moreover, the user can set size parameters of the sheets loaded in each feeding tray through a sheet size setting window of each feeding tray. The setting of the parameters through the user interface may be executed through a predetermined application program executed by an external computer.

On a print setting window shown in FIG. 3, there can be selected setting (the replacement OFF) in which the printing is not executed on the replacement sheet when no designated sheet exists or setting in which the printing is executed on the replacement sheet when no designated sheet exists. In the setting in which the printing is executed on the replacement sheet, there can be selected setting (the replacement ON) in which the printing is tried on the replacement sheet without change upon inputting the print data, setting (the automatic continuity) in which the printing is tried on the replacement sheet after the input of the print data and the expiration of a certain period when a predetermined condition is satisfied, and setting (the FitPage) in which the printing is executed after the size of the actual data of the print data is changed so as to be suitable for the size of the replacement sheet.

On a sheet size setting window of the feeding tray shown in FIG. 3, six feeding trays are equipped in the printer 100, for example, and the size of a sheet accommodated in each feeding tray can be selected from a pull-down menu. When the user sets the size of the sheet accommodated in each feeding tray on the sheet size setting window, the setting value is stored in the semiconductor memory 12, the controller 10 determines the sheet size of the sheet accommodated in each feeding tray with reference to the semiconductor memory 12. In the example shown in the drawing, the sheets of the A4 size, the sheets of the Letter size, the sheets of the A3 size, the sheets of the Legal size, the sheets of the postcard size, and the sheets of the B4 size are accommodated in Feeding Tray 1, Feeding Tray 2, Feeding Tray 3, Feeding Tray 4, Feeding Tray 5, and Feeding Tray 6, respectively. When a mechanism such as a sheet guide capable of automatically detecting a sheet size is installed in the printer 100, it is not necessary for the user to set the sheet size of each feeding tray.

FIGS. 4 to 7 are explanatory diagrams illustrating size change ratios in the replacement printing. In FIGS. 4 to 7, the replacement printing is executed on the A4 sheet and the Letter sheet, for example.

Figure 4:
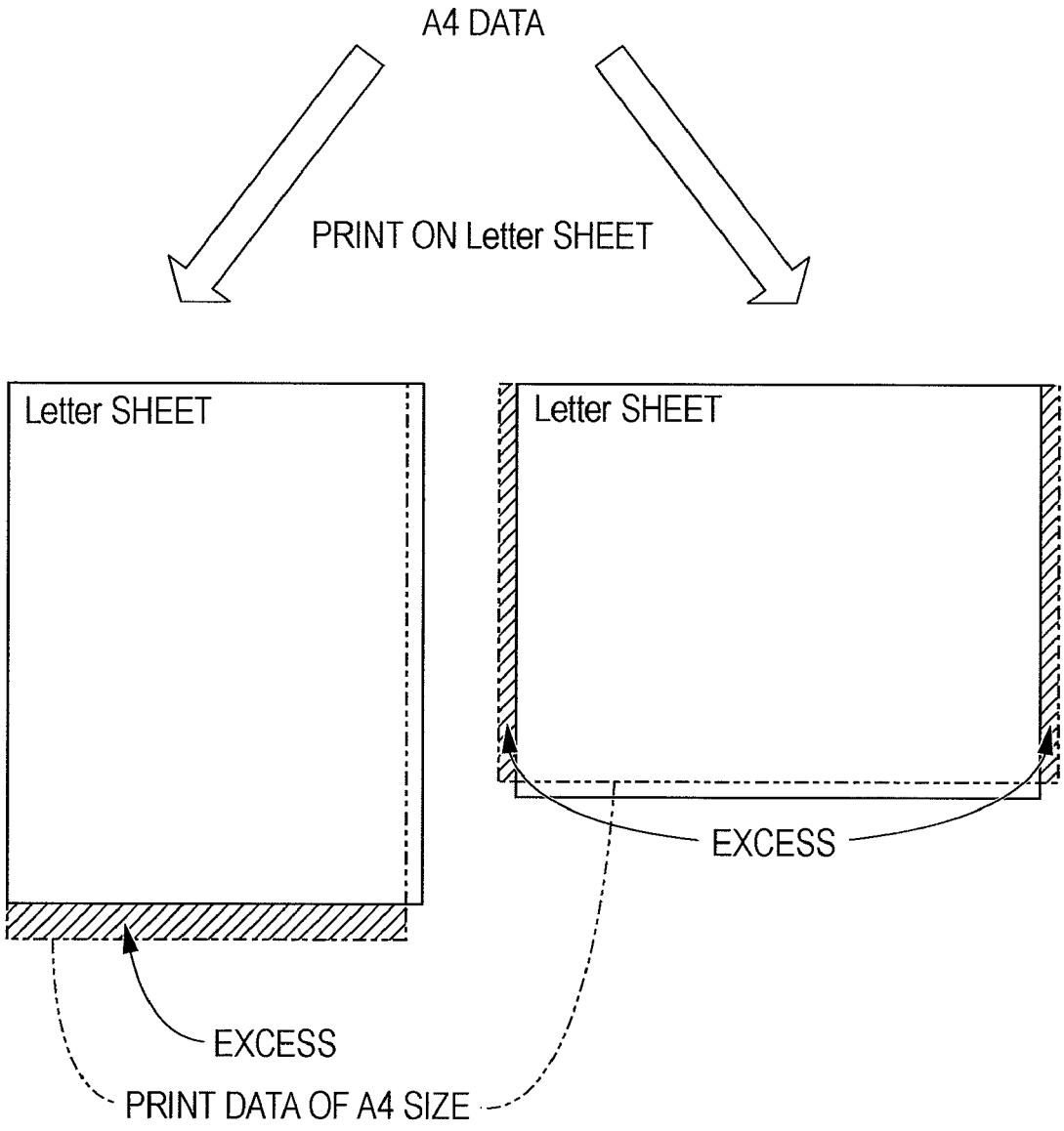
FIG. 4 is an explanatory diagram explaining a size change ratio in replacement printing.
Figure 5:
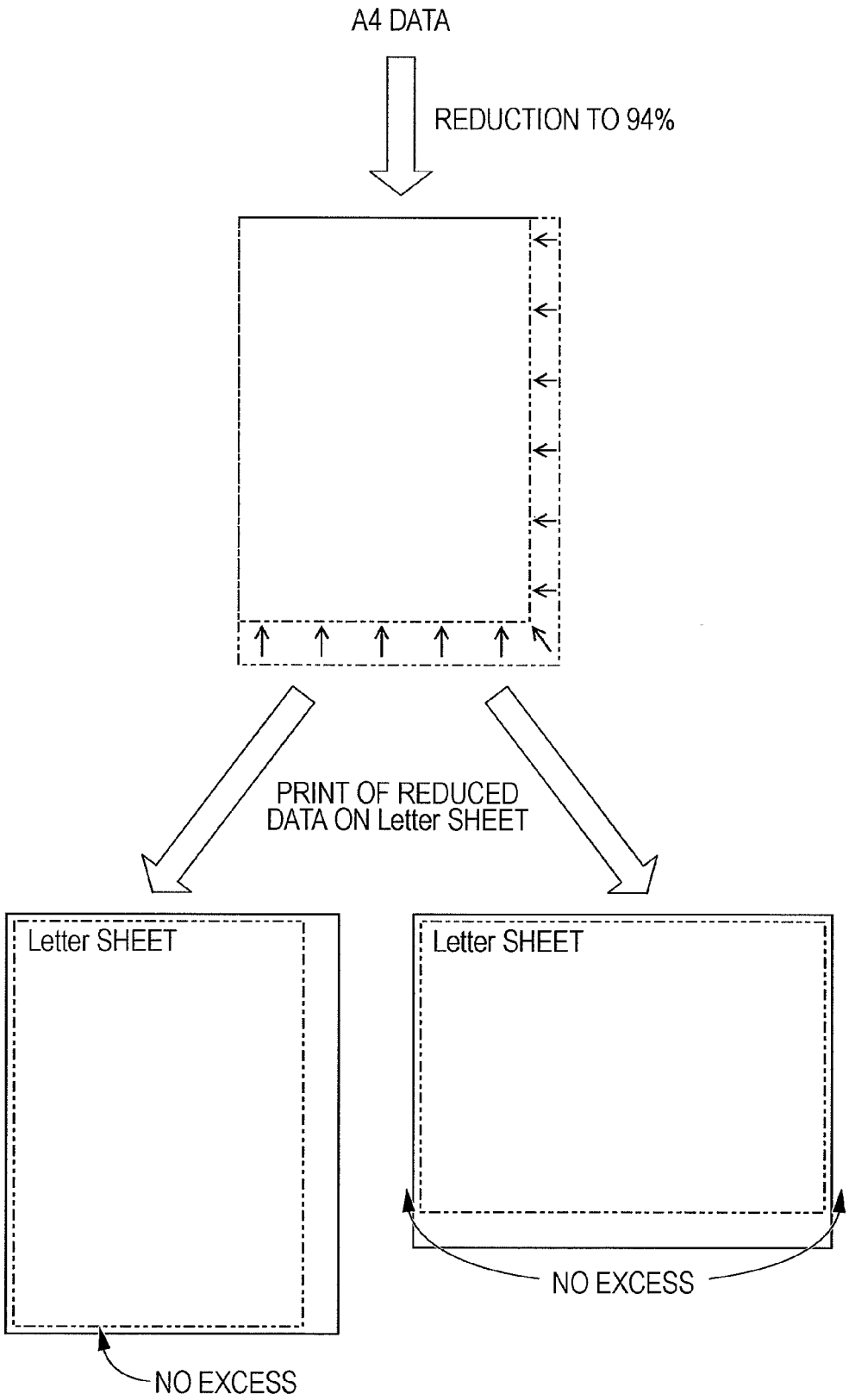
FIG. 5 is an explanatory diagram explaining a size change ratio in the replacement printing.
Figure 6:
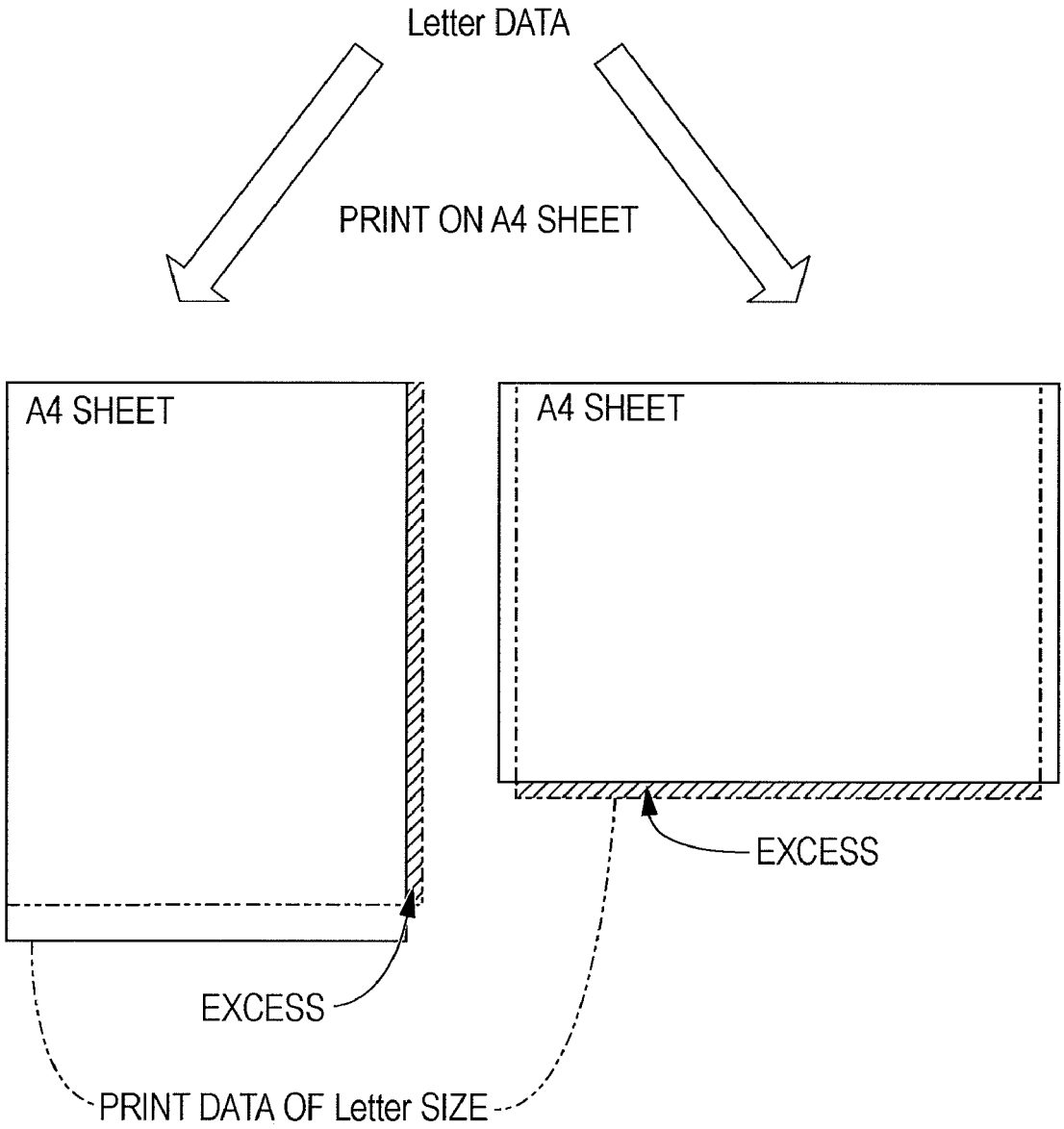
FIG. 6 is an explanatory diagram explaining a size change ratio in the replacement printing.
Figure 7:
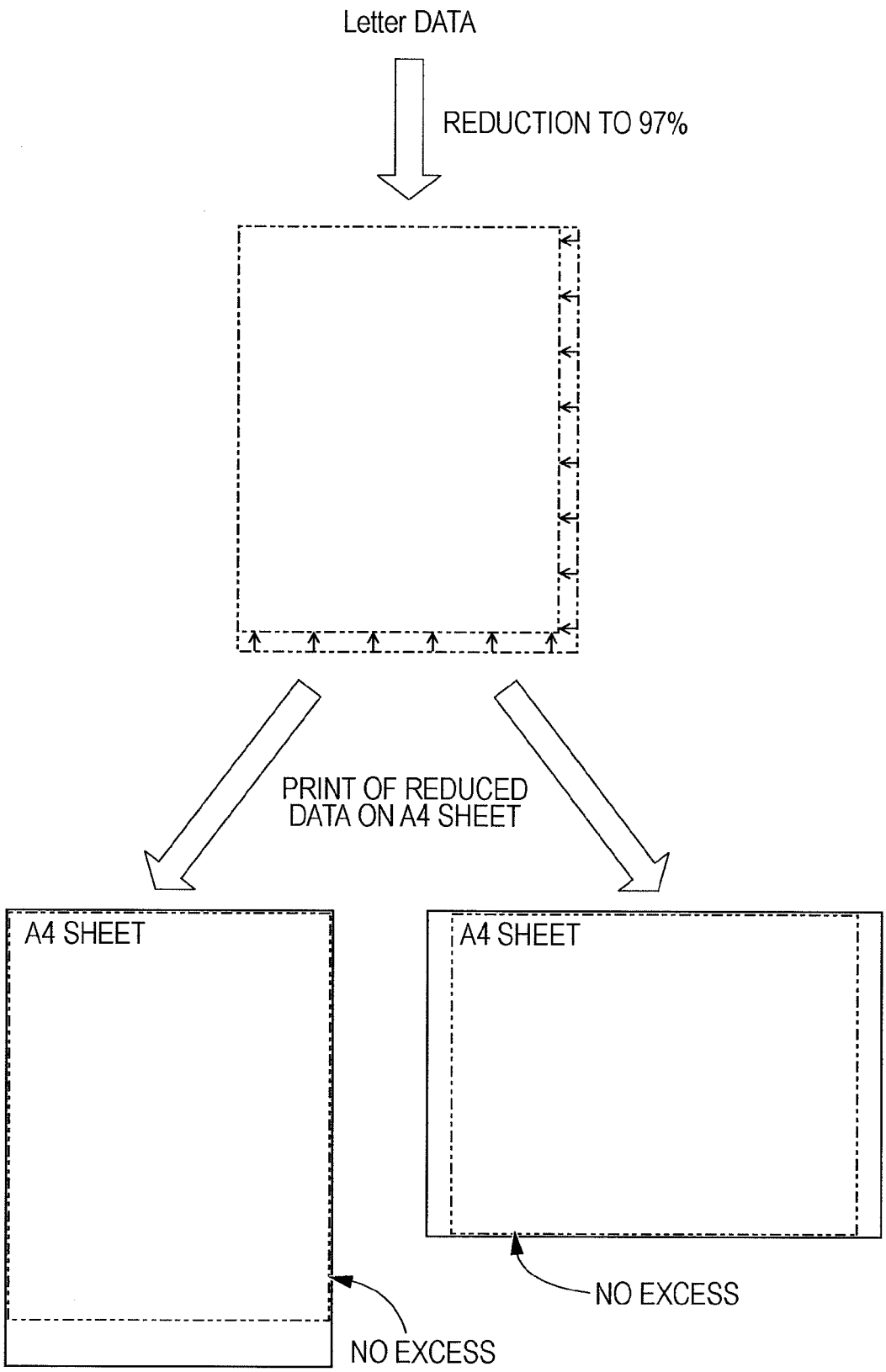
FIG. 7 is an explanatory diagram explaining a size change ratio in the replacement printing.

As shown in FIG. 4 or 6, the raster data generated with the A4 size is printed on a Letter sheet without change or the raster data generated with the Letter size is printed on an A4 sheet, an excess portion occurs. Therefore, in this embodiment, the same reduction ratio shown in FIG. 5 or 7 is set as one type of print control information in the environment variable to execute the printing.

For example, when image data with the A4 size is formed on the Letter sheet by the replacement printing, a reduction ratio of 94% is set in the environment variable. This reduction ratio is set so as to fit in the longer length of the A4 sheet.

For example, when image data with the Letter size is formed on the A4 sheet by the replacement printing, a reduction ratio of 97% is set in the environment variable. This reduction ratio is set so as to fit in the shorter with of the A4 sheet. In this case, the clip area is not taken into consideration and an outside area of the clip area is also the printing area.

(3) Print Control Process

Figure 8:
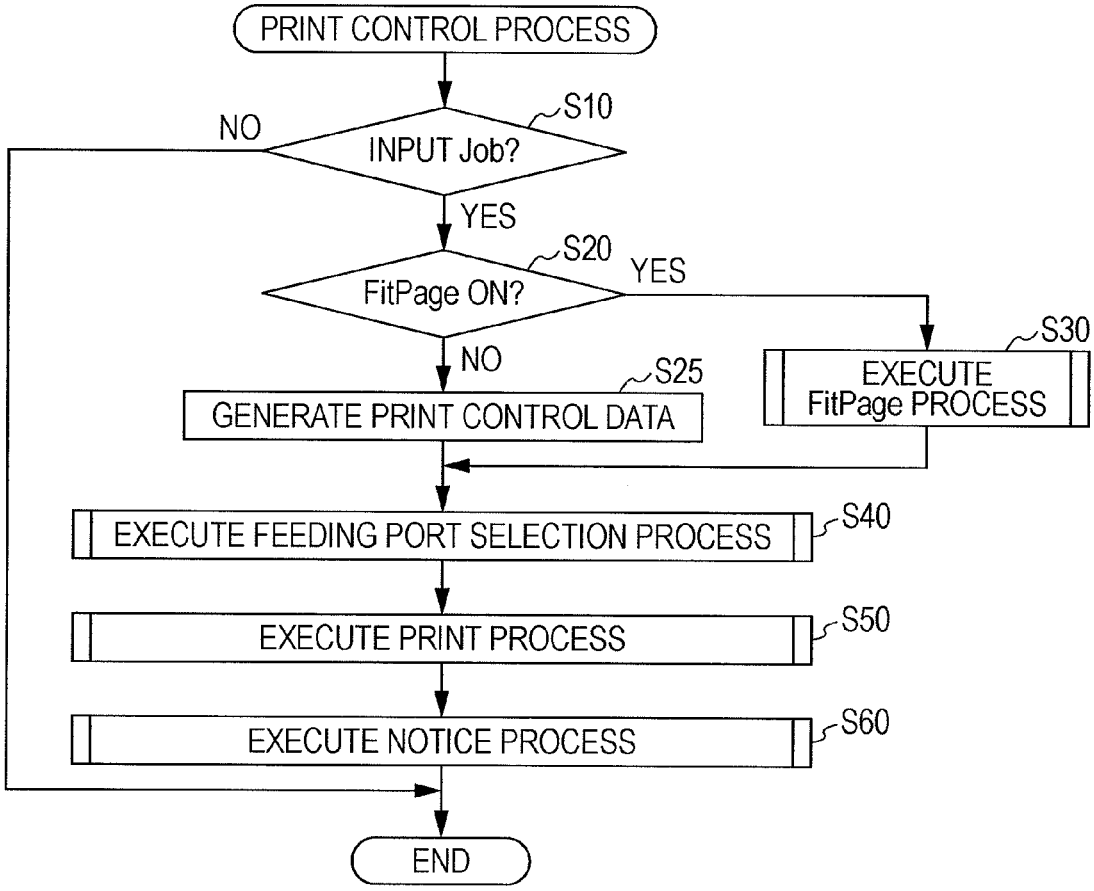
FIG. 8 is a flowchart illustrating a print control process.
Figure 9:
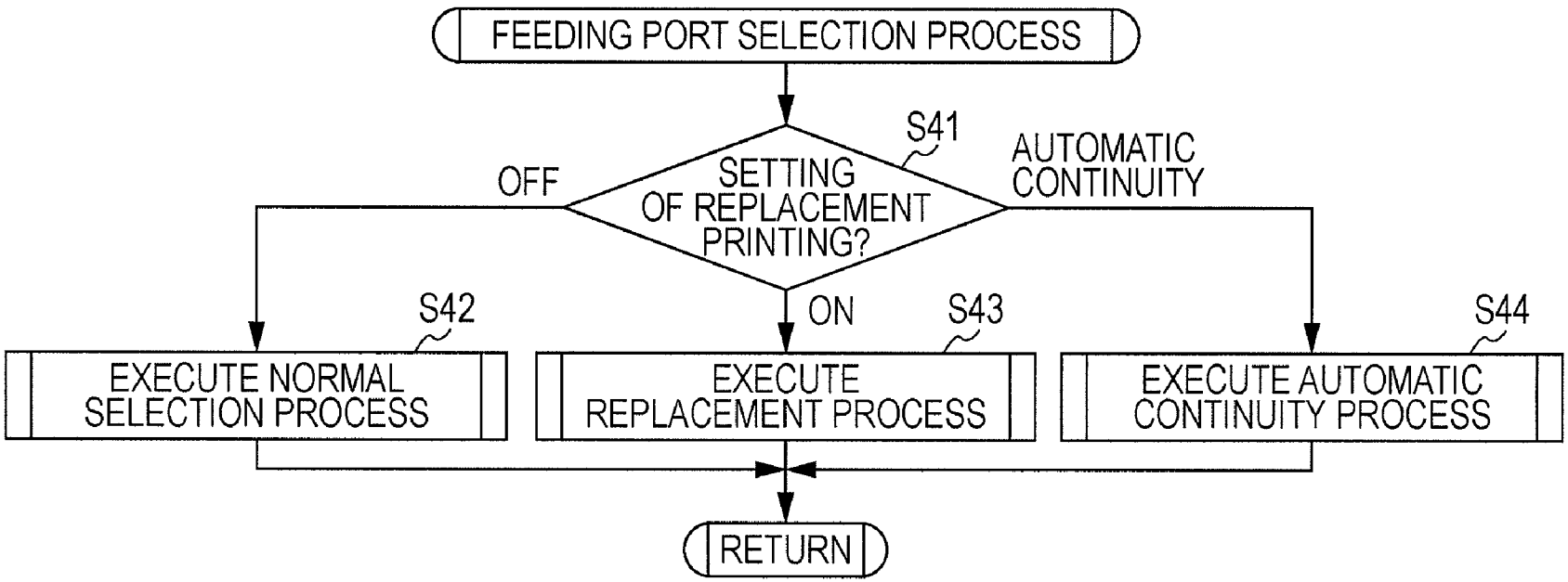
FIG. 9 is a flowchart illustrating a feeding port selection process.

The print control process executed by the print control program P using the above-described configuration and the setting values will be described with reference to FIGS. 8 and 9. FIG. 8 is a flowchart illustrating the print control process. FIG. 9 is a flowchart illustrating a feeding port selection process executed in the print control process.

In step S10 (hereinafter, the term "step" is omitted), the print controller M3 determines whether the print data is input. The print controller M3 proceeds to S20 when the print data is input. At this time, the print controller M3 controls the print data analyzer M1 to acquire the designated size of the input print data. The acquired designated size is temporarily stored in the RAM 10*b* or the like. Alternatively, the print controller M3 terminates the print control process when the print data is not input.

In S20, the print controller M3 determines whether the FitPage is set in the print parameter. That is, the print controller M3 acquires the setting value with reference to a predetermined address of the semiconductor memory 12 and determines whether the acquired setting value is a setting value corresponding to the FitPage. The print controller M3 instructs the data size changing section M34 to change the data size, when the FitPage is set. Then, the data size changing section M34 proceeds to S30 to execute the FitPage process. The details of the FitPage process are described below. The data size changing section M34 outputs the print data of which the size is changed to the print controller M3, when the FitPage process ends. The print controller M3 executes the feeding port selection process of S40 on the basis of the changed print data. Alternatively, the print controller M3 proceeds to S25, when the FitPage is not set.

In S25, the print controller M3 causes the print data analyzer M1 to generate print control data such as the raster data and the print control information, which are necessary to drive the printing engine 23, on the basis of the print data. The generated raster data is stored in the image memory and the generated print control information is stored in a predetermined area of the RAM 10*b*. Then, the print controller M3 executes the feeding port selection process of S40.

Figure 13:
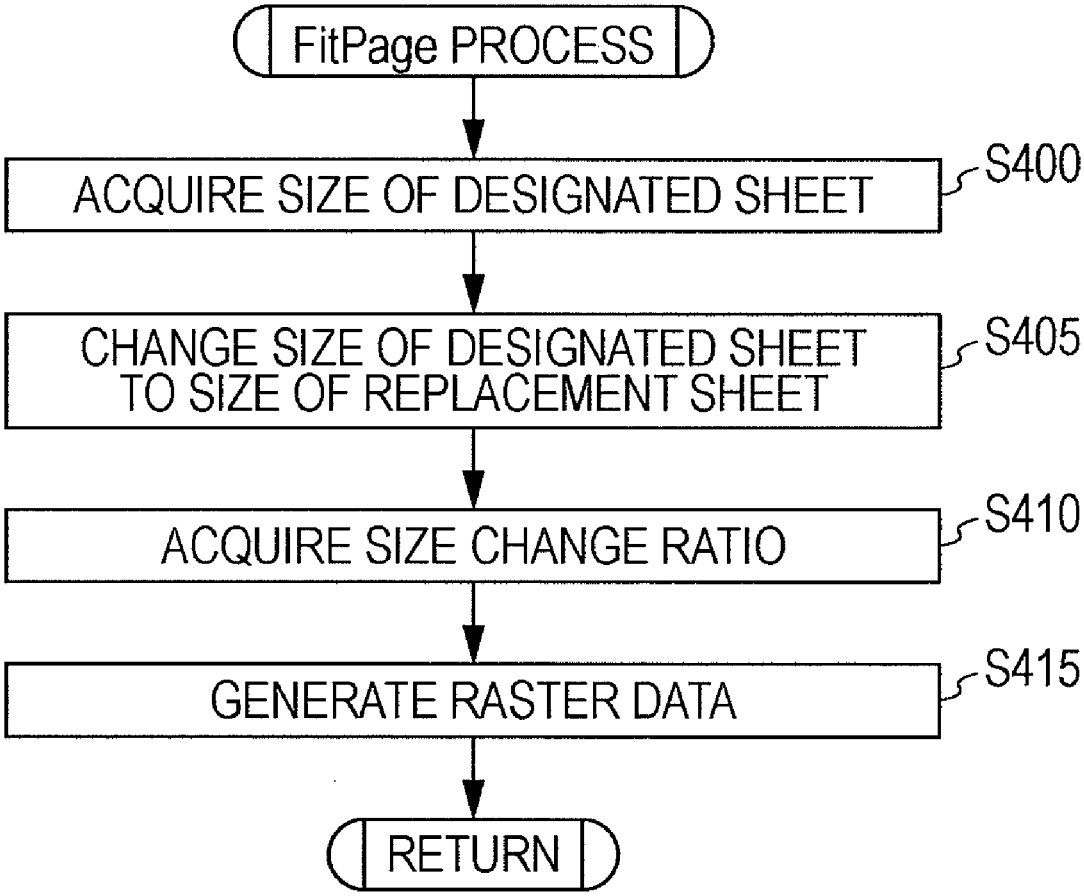
FIG. 13 is a flowchart illustrating a FitPage process.

Now, the FitPage process of S30 will be described. The FitPage process corresponds to the processes from S400 to S415 in FIG. 13. FIG. 13 is a flowchart illustrating the FitPage process.

In S400, the data size changing section M34 acquires the designated size stored in the RAM in S10 by the print data analyzer M1.

In S405, the data size changing section M34 changes the designated size in the print data to the replacement size.

In S410, the data size changing section M34 acquires a change ratio used to change the raster data generated on the basis of the print data so as to have the size fitting in the replacement sheet. For example, when the designated size is the A4 size and the replacement size is the Letter size, the reduction ratio of 94% shown in FIG. 5 is acquired. On the contrary, when the designated size is the Letter size and the designated size is the A4 size, the reduction ratio of 97% shown in FIG. 7 is acquired. Of course, when a sheet larger than the designated size is designated as the replacement sheet, the size may be extended.

In S415, the data size changing section M34 designates the scale ratio acquired in S410 and causes the print data analyzer M1 to generate the raster data from the print data. That is, the print data analyzer M1 applies the change ratio acquired in S410 upon generating the raster data of each plane of CMYK by rasterizing a print job and generates the raster data of which the size is changed. The data size changing section M34 stores the raster data, of which the size is changed, in the image memory. At this time, the print data analyzer M1 stores the size of the replacement sheet as the designated size of the print control information. When S415 ends, the process returns to the print control process in FIG. 8 to execute the process of S40.

The feeding port selection process of S40 corresponds to the processes from S41 to S44 in FIG. 9.

In S41, the print controller M3 determines setting of the replacement printing. That is, the print controller M3 acquires the setting value with reference to the predetermined address of the semiconductor memory 12 and determines whether this setting value indicates one of the print settings.

The print controller M3 causes the general printing section M31 to execute a normal sheet selection process of S42, when the setting is the replacement OFF. The print controller M3 causes the replacement printing section M32 to execute a replacement process of S43, when the setting is the replacement ON. The process proceeds to S44 to execute the automatic continuity process, when the setting is the automatic continuity. The details of the processes in S42 to S44 are described below. When one of the processes in S42 to S44 ends, a process of S50 in FIG. 8 is executed.

In S50, the print controller M3 generates the environment variable reflecting the result of the process of S40 and the print control data used to control the printing engine 23 on the basis of raster data and outputs the generated environment variable and the print control data to the printing unit 20. The printing engine 23 controls the units (the feeding tray 21, the feeding mechanism 22, the discharging mechanism 24, the transporting mechanism, the carriage mechanism, and the printing head) of the printing unit 20 and outputs a desired print result. When the printing ends, the print controller M3 temporarily stores the designated size stored in the environment variable and the information regarding the normal sheet size used in effect in the printing in the RAM 10*b* and causes the print result informer M5 to execute a notice process of S60.

Figure 14:
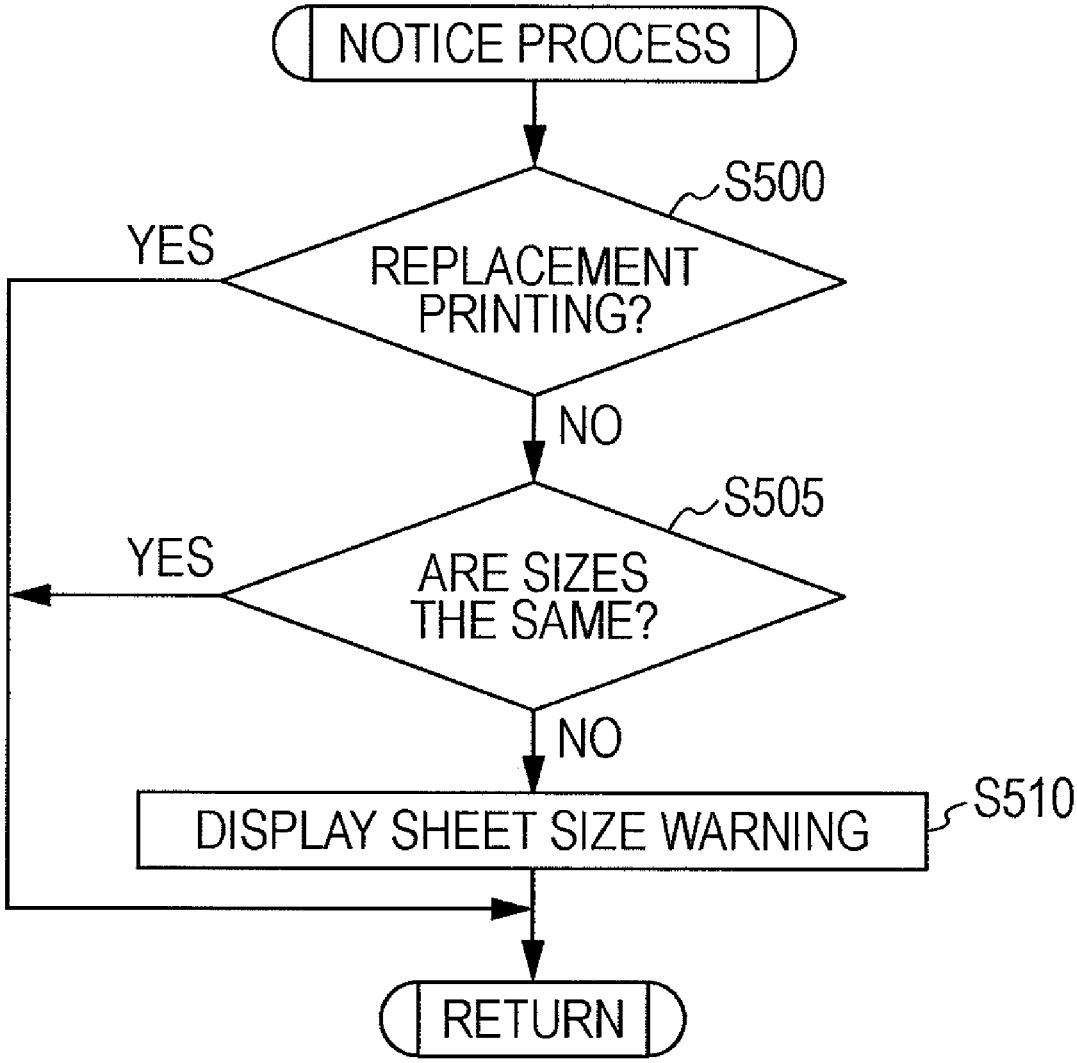
FIG. 14 is a flowchart illustrating a notice process.

The notice process of S60 corresponds to processes of S500 to S510 in FIG. 14. FIG. 14 is a flowchart illustrating the notice process executed when the printing ends.

In S500, the print result informer M5 determines whether the replacement printing in the print process of S50 is executed. The print result informer M5 terminates the notice process and the print control process without giving a warning message, when the replacement printing is executed. Alternatively, the process proceeds to S505, when the replacement printing is not executed. The print result informer M5 acquires the setting value with reference to the predetermined address of the semiconductor memory 12 to determine the replacement setting. When the designated size and the normal sheet size have the replacement relationship in the case of the replacement ON or the automatic continuity, it can be determined that the replacement printing is executed. When information indicating that the general printing section M31 or the replacement printing section M32 selects the replacement sheet during the above-described feeding port selection process is stored in the RAM 10*b* or the like, this determination may be made by acquiring this information.

In S505, the print result informer M5 determines whether the designated size is identical to the normal sheet size. When the designated size is not the same as the normal sheet size, the process proceeds to S510. Then, the print result informer M5 displays a sheet size warning on the display 17 and then terminates the notice process and the print control process. Alternatively, when the designated size is identical to the normal sheet size, the print result informer M5 just terminates the notice process and the print control process.

(4) Feeding Port Selection Process

Figure 10:
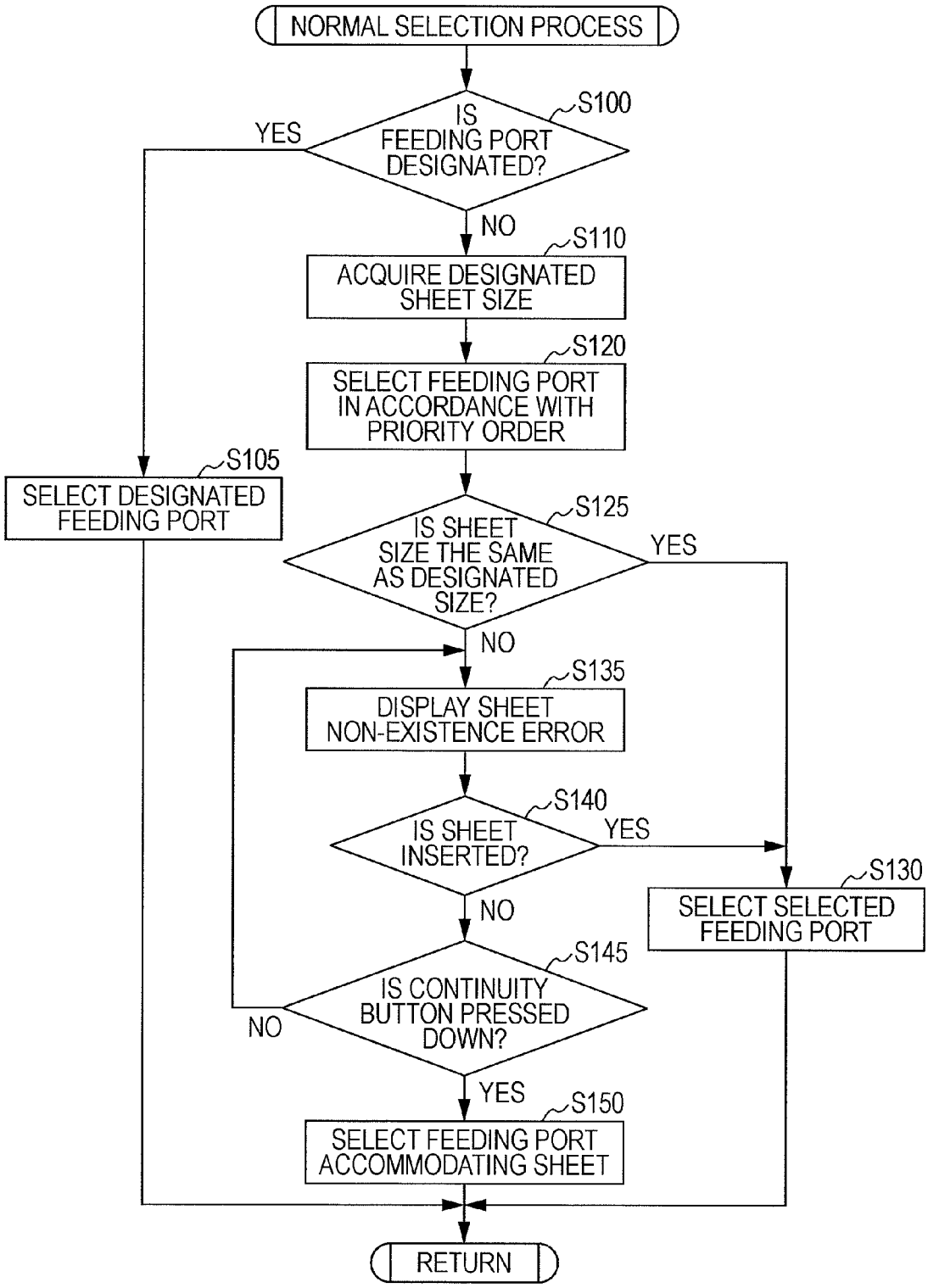
FIG. 10 is a flowchart illustrating a normal sheet selection process.
Figure 11:
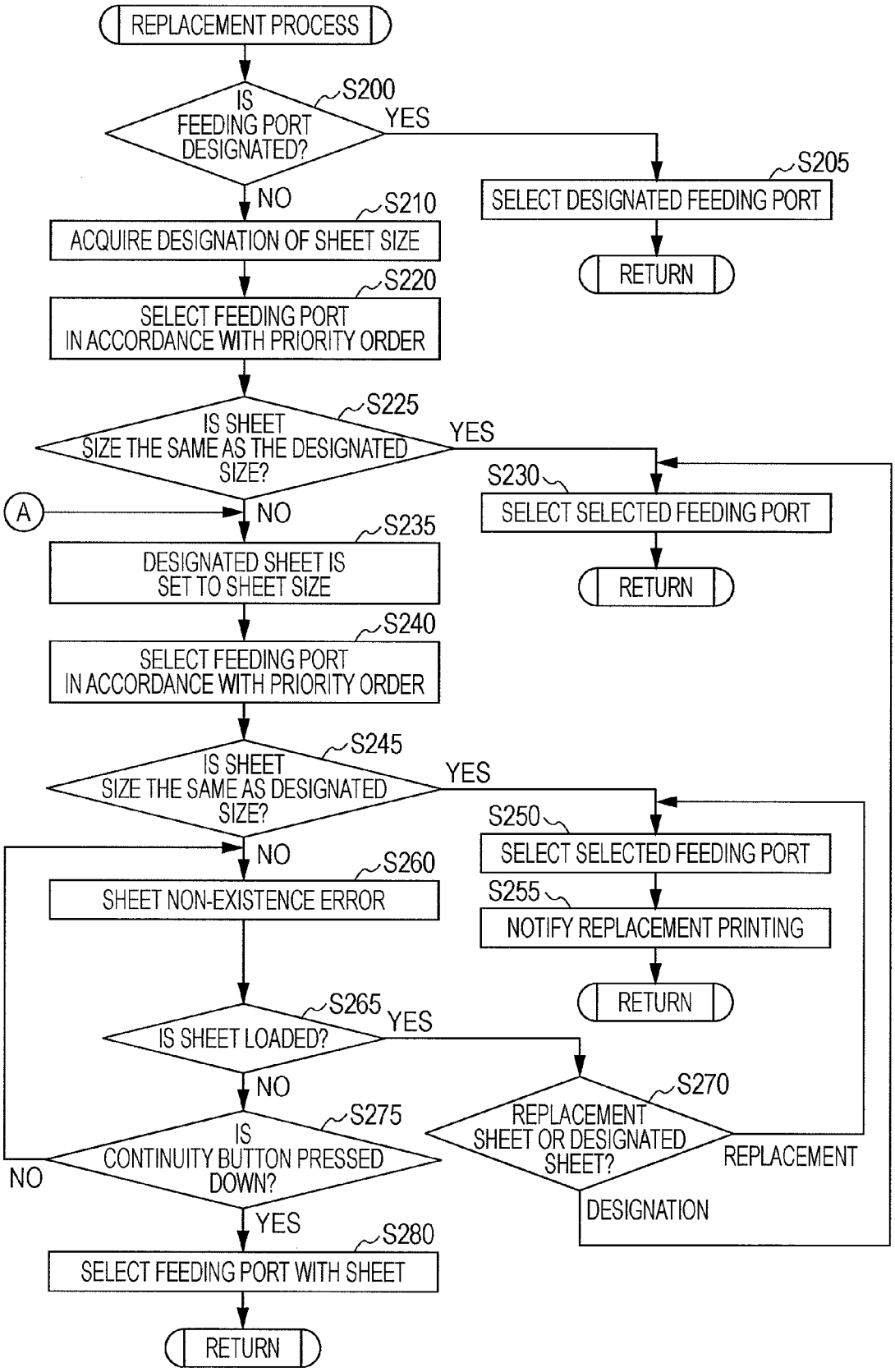
FIG. 11 is a flowchart illustrating a replacement process.
Figure 12:
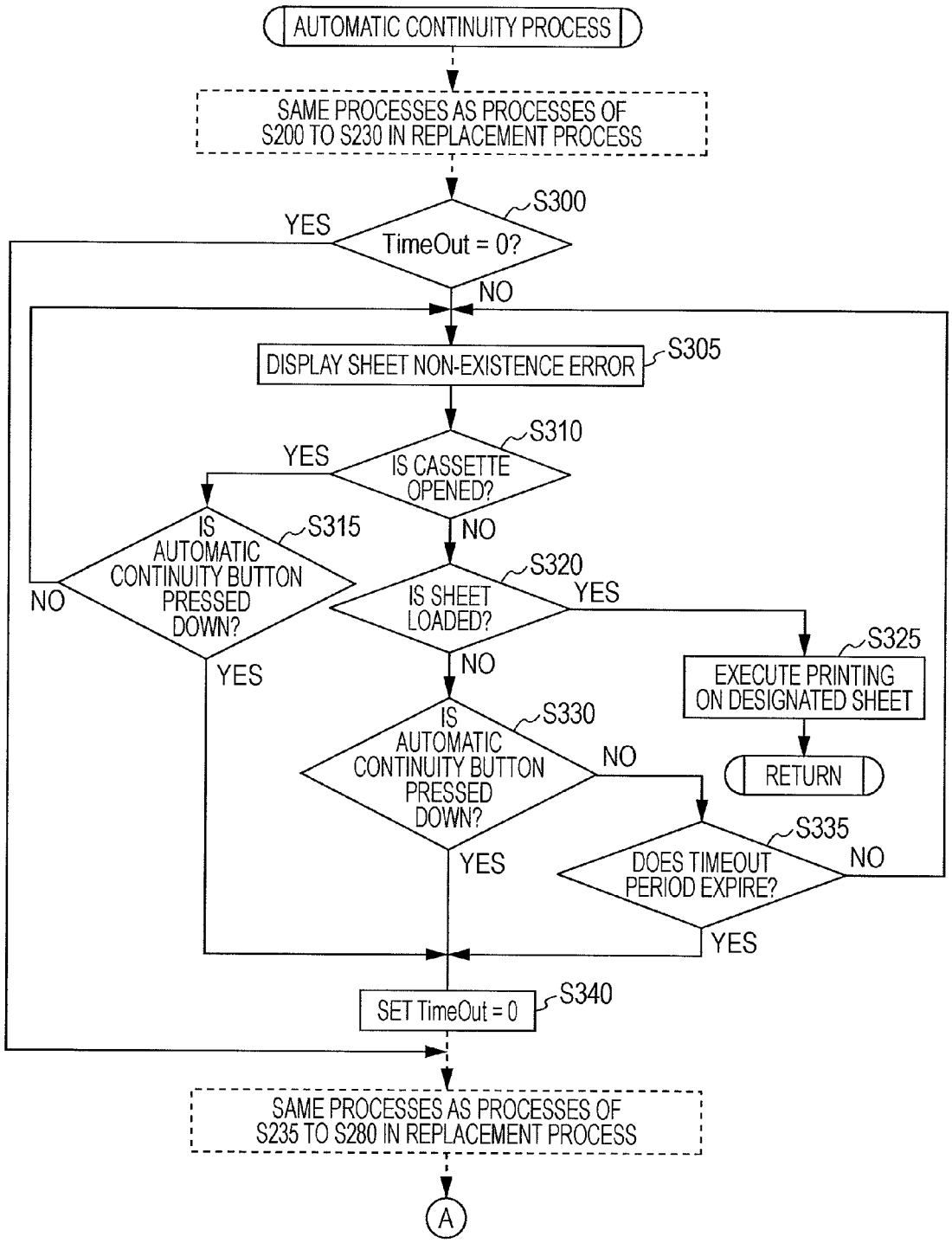
FIG. 12 is a flowchart illustrating an automatic continuity process.

Next, the feeding port selection process will be described with reference to FIGS. 10 to 12. FIG. 10 is a flowchart illustrating the normal sheet selection process of S42. FIG. 11 is a flowchart illustrating the replacement process of S43. FIG. 12 is a flowchart illustrating the automatic continuity process of S44.

(4-1) Normal Selection Process

When S42 is selected in the feeding port selection process, in S100, the general printing section M31 determines whether the feeding port is designated in the print control information. That is, the general printing section M31 acquires the environment variable regarding the feeding port from the RAM 10*b*. When the feeding port is designated in the environment variable, the process proceeds to S105. Alternatively, when the feeding port is not designated in the environment variable, the process proceeds to S110. The general printing section M31 selects the feeding port and causes the print controller M3 to execute the process of S50, when the process proceeds to S105.

In S110, the general printing section M31 acquires the sheet size designated in the environment variable.

In S120, the general printing section M31 selects the feeding port corresponding to the designated size. For example, when the sheets are accommodated in the respective feeding trays as in FIG. 3, the general printing section M31 can grasp the sheet size of each sheet accommodated in each feeding tray by acquiring information regarding the sheet size of each sheet accommodated in each feeding tray from the semiconductor memory 12. In this example, the general printing section M31 selects Feeding Tray 1, when A4 is designated in the print data. However, when the sheet is used up in the feeding tray, the general printing section M31 selects the feeding tray accommodating the sheet of the subsequent priority in accordance with the sheet priority order upon the selection of A4. That is, when the sheet priority order is the order of the feeding trays, the Letter sheet accommodated in Feeding Tray 2 is first selected. When the Letter sheet is also used up, the A3 sheet accommodated in subsequent Feeding Tray 3 is selected. That is, in S120, one of the feeding trays is selected as long as the sheet is not used up in any one of all the feeding trays.

In S125, the general printing section M31 determines whether the sheet size of the feeding port selected in S120 is the same as the designated size. When the sheet size is the same as the designated size, the process proceeds to S130. Then, the general printing section M31 instructs the print controller M3 to execute the printing by use of the sheet accommodated in the selected feeding port. Alternatively, when the sheet size is not the same as the designated size, the process proceeds to S135.

In S135, the general printing section M31 displays a sheet non-existence error, such as "No A4 exists in Feeding Tray 1", on the display 17.

In S140, the general printing section M31 determines whether a sheet is supplemented in the feeding tray which has caused the notice of the sheet non-existence error in S135. When the sheet is supplemented, the process proceeds to S130. Then, the general printing section M31 instructs the print controller M3 to execute the printing by use of the sheets accommodated in the selected feeding port. Alternatively, when no sheet is supplemented, the process proceeds to S145. It is assumed that the printer 100 includes a mechanism which detects whether the sheet is accommodated in each feeding tray (the sheet is supplemented).

In S145, the general printing section M31 determines whether the continuity button of the operational panel 16 is pressed down. When the continuity button is not pressed down, the process returns to S135. Then, the general printing section M31 continues to display the sheet non-existence error and awaits the supplement of the sheet or the press of the continuity button. Alternatively, when it is detected that the continuity button is pressed down, the process proceeds to S150. Then, the general printing section M31 causes the print controller M3 to execute the printing by use of the feeding port selected in S120.

However, when either the continuity button is not operated or no sheet is supplemented, there is a possibility of awaiting the operation or the supplement for a long time. Therefore, the printer 100 continues to be occupied. As a consequence, there is a possibility that not only the user instructing the printing of the print data, which is a cause of the waiting but other users cannot execute printing. Moreover, in a page printer capable of receiving print data in unit of a page, the waiting in S145 may occur for every print data. Therefore, when a printing product of plural pages is printed, the continuity button has to be pressed down by the same number as the number of pages. Furthermore, when the printing is executed using the feeding port selected in S120, for example, when only the sheet of the postcard size exists in the feeding tray, the print data scheduled to be printed on the sheet of the A4 size may be printed on the sheet of the postcard size. In this case, since a part containing important details of a printing product may not be printed, the sheet also becomes useless.

In order to solve this problem, the printer 100 according to this embodiment is configured to execute the replacement process of S43, which is described below, the automatic continuity process of S44, or the FitPage process of S30.

(4-2) Replacement Process

When S43 is selected in the feeding port selection process, the replacement printing section M32 executes the same processes as the processes from S100 to S120 in the normal selection process of S200 to S220.

In S225, the replacement printing section M32 determines whether the sheet size accommodated in the feeding port selected in S220 is identical to the designated size. When the sheet size is identical to the designated size, the process proceeds to S230. Then, the replacement printing section M32 instructs the language analyzer M7 to execute the printing by use of the sheet in the selected feeding port. Alternatively, when the sheet size is not the same as the designated size, the process proceeds to S235.

In S235, the replacement printing section M32 selects the sheet (the replacement sheet) of the size which is replaceable by the designated sheet as the printing sheet. That is, when the designated sheet is the Letter sheet, the replacement printing section M32 selects the A4 sheet. When the designated sheet is the A4 sheet, the replacement printing section M32 selects the Letter sheet.

In S240, the replacement printing section M32 selects the feeding tray accommodating the replacement sheet. For example, when the designated size is the A4 size and the sheet is accommodated in each feeding tray as in FIG. 3, the replacement printing section M32 selects Feeding Tray 2 accommodating the Letter sheet.

Like the case in S120, the sheet is used up in Feeding Tray 2 in some cases. In this case, the replacement printing section M32 selects the feeding tray accommodating the sheet of the subsequent priority in accordance with the sheet priority order. However, this step is different from the step of S120 in the normal selection process. The feeding tray accommodating the sheet of the subsequent priority is selected in accordance with the sheet priority order.

In S245, the replacement printing section M32 determines whether the sheet size of the sheet accommodated in the feeding tray selected in S240 is identical to the designated size. When the sheet size is identical to the designated size, the process proceeds to S250. Then, the replacement printing section M32 instructs the print controller M3 to execute the printing by use of the selected feeding port and displays the execution of the replacement printing in S255 on the display 17. Alternatively, when the sheet size is not the same as the designated size, the replacement printing section M32 permits proceeding to S260.

In S260, the replacement printing section M32 displays a sheet non-existence error, such as "Either A4 sheet or Letter sheet does not exist in the feeding tray". That is, a message indicating that neither the sheet of the designated size nor the sheet of the replacement size exists is displayed on the display 17.

In S265, the replacement printing section M32 determines whether a sheet is supplemented in the feeding tray which has caused the notice of the sheet non-existence error in S260. When the sheet is supplemented, the replacement printing section M32 permits proceeding to S270. Alternatively, when the sheet is not supplemented, the process proceeds to S275.

In S270, the replacement printing section M32 determines whether one of the designated sheet and the replacement sheet is supplemented. At this time, the replacement printing section M32 considers a case where the designated sheet is supplemented, a case where the replacement sheet is supplemented, and a case where both the designated sheet and the replacement sheet are supplemented. When the designated sheet is supplemented, the process proceeds to S230 and the print controller M3 is instructed to execute the printing by use of the feeding port selected in S220. Alternatively, when the replacement sheet is supplemented, the process proceeds to S250 and the print controller M3 is instructed to execute the printing by use of the feeding port selected in S240. Alternatively, when both the designated sheet and the replacement sheet are supplemented, the process may proceed to one of S230 and S250.

In S275, the replacement printing section M32 determines whether the continuity button of the operational panel 16 is pressed down. When it is not detected that the continuity button is pressed down, the process returns to S260. Then, the replacement printing section M32 continues to display the sheet non-existence error and awaits the supplement of the sheet or the press of the continuity button. Alternatively, when it is detected that the continuity button is pressed down, the general printing section M31 permits proceeding to S280. In S280, the print controller M3 is instructed to execute the printing by use of the feeding port selected in S240.

(4-3) Automatic Continuity Process

When S44 is selected in the feeding port selection process, the automatic continuity printing section M33 executes the same processes as the processes of S200 to S230 in the replacement process. Subsequently, the automatic continuity printing section M33 executes the processes of S300 to S340.

In S300, the automatic continuity printing section M33 determines whether a timeout period TO is set. When TO=0, the automatic continuity printing section M33 skips the processes of S305 to S340 and executes the same processes as the processes of S240 to S280 in the replacement process. Alternatively, when TO=n (where n is a number greater than 0), the process proceeds to S305. Then, the automatic continuity printing section M33 displays non-existence of the designated sheet on the display 17.

In S310, the automatic continuity printing section M33 determines whether the feeding tray (cassette) is opened. It is assumed that the printer 100 includes a mechanism which detects whether each feeding tray 21 is extracted (whether a sheet is supplemented). When the feeding tray is opened, the automatic continuity printing section M33 permits proceeding to S315. Alternatively, when the feeding tray is not opened, the process proceeds to S320.

In S315, the automatic continuity printing section M33 determines whether the continuity button is pressed down. When it is detected that the continuity button is pressed down, the automatic continuity printing section M33 permits proceeding to S340. Alternatively, when it is not detected that the continuity button is pressed down, the process returns to S305. The continuity button is the same as that described in S145 in the normal selection process.

In S320, the automatic continuity printing section M33 determines whether a sheet is supplemented. When the supplement of the designated sheet is detected in the environment variable, the process proceeds to S325. The automatic continuity printing section M33 instructs the language analyzer M7 to execute the printing on the designated sheet. Alternatively, when the supplement of the designated sheet is not detected, the automatic continuity printing section M33 permits proceeding to S330.

In S330, the automatic continuity printing section M33 determines whether the continuity button is pressed down. When it is detected that the continuity button is pressed down, the automatic continuity printing section M33 permits proceeding to S340. Alternatively, when it is not detected that the continuity button is pressed down, the process proceeds to S335.

In S335, the automatic continuity printing section M33 determines whether a timeout period expires. When the timeout period expires, the automatic continuity printing section M33 permits proceeding to S340. Alternatively, when the timeout period does not expire, the process returns to S305. A clock signal is supplied from the timer M6 and the automatic continuity printing section M33 counts a time after the timeout period is acquired in S300.

In S340, the automatic continuity printing section M33 sets the timeout period TO set in the semiconductor memory 12 to 0. That is, in this embodiment, the automatic continuity process is awaited only when a sheet error initially occurs after the power-on of the printer 100. This is because the shortage of the mainly used sheet such as the A4 sheet does not frequently occur and the A4 sheets are used for a relatively long time after the supplement. Moreover, this is because the downtime may be increased due to the relatively long set timeout period of the automatic continuity process for supplementing the sheets, when the automatic continuity process is frequently executed.

In order to realize the advantage of the automatic continuity process and reduce the downtime, occurrence of waiting time may be restricted to one-time per one day by resetting the timeout period to TO=n when the printer is first turned on in a day, for example. Alternatively, the waiting may be set only in the initially occurring sheet error by setting TO=n after a printing apparatus is delivered and then activated. When S340 ends, the automatic continuity printing section M33 executes the same processes as the processes of S240 to S280 in the replacement process.

(5) Summary

As described above, the printer 100 according to this embodiment includes the plurality of feeding trays. The printer is configured to select: the setting of designating the printing on one of the sheets accommodated in the feeding trays when the designated sheet designated in the print control information does not exist; the setting of designating the printing on the replacement sheet of the designated sheet when the designated sheet does not exist; and the setting of designating the printing on the replacement sheet of the designated sheet after waiting for the predetermined period until the supplement of the designated sheet when the designated sheet does not exist. Accordingly, since the optimum setting can be selected depending on the use environment of the printer 100, it is possible to reduce the downtime consequently.

The invention is not limited to the above-described embodiment or the modifications thereof, but includes an implementation in which the configurations of the above-described embodiment and the modifications are replaced or changed or an implementation in which the configurations of the related art, the above-described embodiment, and the modifications are replaced or changed.

The entire disclosure of Japanese Patent Application No. 2009-003404, filed Jan. 9, 2009 and No. 2009-192093, filed Aug. 21, 2009 are expressly incorporated by reference herein.

What is claimed is:

1. A printing apparatus including one or more feeding units, comprising:

a sheet size determining unit which determines a sheet size of a sheet, on which print data are printed, in predetermined order;

a print control unit which stores a designated size, which is the sheet size determined by the sheet size determining unit, in a storage unit;

a feeding unit selector which selects the feeding unit on the basis of the designated size; and a process selection information storing unit which stores process selection information used to designate a process executed by the print control unit, wherein on the basis of the process selection information, the print control unit selectively executes one of:

a first process of executing printing on a sheet in the feeding unit selected by the feeding unit selector when the sheet size set in the feeding unit selected by the feeding unit selector is identical to the designated size, giving notice that no sheet exists when the sheet size set in the feeding unit selected by the feeding unit selector is different from the designated size, and executing the printing on the sheet when the sheet of the designated size is supplemented;

a second process of executing printing on the sheet in the feeding unit selected by the feeding unit selector when the sheet size set in the feeding unit selected by the feeding unit selector is identical to the designated size, selecting the feeding unit on the basis of a replacement size of the designated size when the sheet size set in the feeding unit selected by the feeding unit selector is different from the designated size, and executing the printing on the sheet in the selected feeding unit when the sheet size set in the selected feeding unit is identical to the replacement size; and a third process of executing printing on the sheet in the feeding unit selected by the feeding unit selector when the sheet size set in the feeding unit selected by the feeding unit selector is identical to the designated size, giving notice that no sheet exists when the sheet size set in the feeding unit selected by the feeding unit selector is different from the designated size, executing the printing on the sheet when the sheet of the designated size is supplemented before the expiration of a predetermined period of time from the notice, and executing the printing on the sheet in the feeding unit selected on the basis of the replacement size of the designated size when the sheet of the designated sheet is not supplemented until the expiration of the predetermined period of time from the notice.

2. A printing apparatus including one or more feeding units, comprising:

a sheet size determining unit which determines a sheet size of a sheet, on which print data are printed, in predetermined order;

a print control unit which stores a designated size, which is the sheet size determined by the sheet size determining unit, in a storage unit;

a feeding unit selector which selects the feeding unit on the basis of the designated size; and a process selection information storing unit which stores process selection information used to designate a process executed by the print control unit, wherein on the basis of the process selection information, the print control unit selectively executes one of:

a first process of executing printing on a sheet in the feeding unit selected by the feeding unit selector when the sheet size set in the feeding unit selected by the feeding unit selector is identical to the designated size, giving notice that no sheet exists when the sheet size set in the feeding unit selected by the feeding unit selector is different from the designated size, and executing the printing on the sheet when the sheet of the designated size is supplemented;

a second process of executing printing on the sheet in the feeding unit selected by the feeding unit selector when the sheet size set in the feeding unit selected by the feeding unit selector is identical to the designated size, selecting the feeding unit on the basis of a replacement size of the designated size when the sheet size set in the feeding unit selected by the feeding unit selector is different from the designated size, and executing the printing on the sheet in the selected feeding unit when the sheet size set in the selected feeding unit is identical to the replacement size;

a third process of executing printing on the sheet in the feeding unit selected by the feeding unit selector when the sheet size set in the feeding unit selected by the feeding unit selector is identical to the designated size, giving notice that no sheet exists when the sheet size set in the feeding unit selected by the feeding unit selector is different from the designated size, executing the printing on the sheet when the sheet of the designated size is supplemented before the expiration of a predetermined period of time from the notice, and executing the printing on the sheet in the feeding unit selected on the basis of the replacement size of the designated size when the sheet of the designated sheet is not supplemented until the expiration of the predetermined period of time from the notice; and a fourth process of changing the dimension of actual data generated on the basis of the print data so as to be equal to the replacement size of the designated size, and executing printing on a sheet of the replacement size.

3. The printing apparatus according to claim 1, wherein in the second process, the print control unit executes the printing at a reduction ratio at which the sheet size determined by the sheet size determining unit falls within the range of the replacement size.

4. The printing apparatus according to claim 1, wherein the print control unit sets the entire sheet containing a clip area to a print range, whenever executing the printing on the sheet of the replacement size.

5. The printing apparatus according to claim 1, wherein in the second process, the print control unit gives notice that no sheet of both the sheet size determined by the sheet size determining unit and the replacement size exists, when no sheet of the replacement size exists.

6. The printing apparatus according to claim 1, wherein in the third process, when the printing is executed on a sheet of the replacement size, the print control unit gives notice of the printing, and wherein in the second process, even when the printing is executed on a sheet of the replacement size, the print control unit does not give notice of the printing.

7. The printing apparatus according to claim 1, wherein when the printing apparatus is turned on and then the third process is executed twice or more, the print control unit gives notice that no sheet of the designated size exists and selects the feeding unit on the basis of the replacement size of the designated size without awaiting the expiration of the predetermined period of time, and when the sheet size set in the selected feeding unit is identical to the replacement size, the print control unit executes the printing on the sheet in the selected feeding unit.

8. The printing apparatus according to claim 1, wherein when one of A4 and Letter is designated as the designated size, the print control unit sets the other of A4 and Letter as the replacement size.

* * * * *